US009550604B2

(12) United States Patent
Burleson, Jr. et al.

(10) Patent No.: US 9,550,604 B2
(45) Date of Patent: Jan. 24, 2017

(54) CAN END WITH STRENGTHENING BEAD CONFIGURATION

(71) Applicant: Silgan Containers LLC, Woodland Hills, CA (US)

(72) Inventors: Lynn A. Burleson, Jr., Fort Dodge, IA (US); John L. Phillips, Waterloo, WI (US); Donald M. Gust, Oconomowoc, WI (US); Rohm E. Bloedorn, Delafield, WI (US)

(73) Assignee: Silgan Containers LLC, Woodland Hills, CA (US)

( * ) Notice: Subject to any disclaimer, the term of this patent is extended or adjusted under 35 U.S.C. 154(b) by 0 days.

(21) Appl. No.: 14/613,041

(22) Filed: Feb. 3, 2015

(65) Prior Publication Data

US 2015/0166216 A1 Jun. 18, 2015

Related U.S. Application Data

(63) Continuation of application No. 13/531,060, filed on Jun. 22, 2012, now Pat. No. 8,978,915, which is a continuation of application No. 13/249,527, filed on Sep. 30, 2011, now abandoned, which is a continuation-in-part of application No. 29/398,281, filed on Jul. 28, 2011, now Pat. No. Des. 685,266, application No. 14/613,041, which is a continuation of application No. 13/531,060, which is a continuation-in-part of application No. 29/398,281, which is a continuation-in-part of application No. 29/377,154, filed on Oct. 18, 2010, now Pat. No. Des. 653,109.

(51) Int. Cl.
*B65D 17/34* (2006.01)
*B65D 6/34* (2006.01)
*B65D 17/00* (2006.01)

(52) U.S. Cl.
CPC ..... *B65D 7/44* (2013.01); *B65D 17/163* (2013.01); *B65D 2517/007* (2013.01); *B65D 2517/0013* (2013.01); *B65D 2517/0073* (2013.01); *B65D 2517/0079* (2013.01)

(58) Field of Classification Search
CPC ..... B65D 17/163; B65D 2517/0079; B65D 2517/0016; B65D 2517/0076
USPC ..... 220/255.1, 270, 276, 269, 272, 273
See application file for complete search history.

(56) References Cited

U.S. PATENT DOCUMENTS 3,416,699 A 12/1968 Bozek
D219,370 S 12/1970 Saunders
(Continued)

OTHER PUBLICATIONS

U.S. Appl. No. 29/471,062, filed Oct. 28, 2013, Burleson, Jr. et al.
(Continued)

*Primary Examiner* — Shawn M Braden
(74) *Attorney, Agent, or Firm* — Reinhart Boerner Van Deuren S.C.

(57) ABSTRACT

A can end that is attached to a metal can body with a bottom end forming a cavity that may be filled with food, liquid, etc. The can end is made of metal with a bead configuration located in the outer circumference of the can end that increases its resistance to deformation when subjected to high pressure cooking environments and assists in preventing the can end from separating along the frangible score.

20 Claims, 9 Drawing Sheets

(56) References Cited

U.S. PATENT DOCUMENTS

| | | | | |
|---|---|---|---|---|
| 3,674,171 | A * | 7/1972 | Fahlbusch | B65D 17/163 220/270 |
| 3,698,590 | A | 10/1972 | Cookson | |
| D226,073 | S | 1/1973 | Westphal | |
| 3,724,709 | A | 4/1973 | Westphal | |
| 4,434,641 | A | 3/1984 | Nguyen | |
| 4,577,774 | A | 3/1986 | Nguyen | |
| 4,808,052 | A | 2/1989 | Bulso, Jr. et al. | |
| 4,865,506 | A | 9/1989 | Kaminski | |
| RE33,217 | E | 5/1990 | Nguyen | |
| 4,930,658 | A | 6/1990 | McEldowney | |
| 4,955,223 | A | 9/1990 | Stodd et al. | |
| 4,977,772 | A | 12/1990 | Bulso, Jr. et al. | |
| 4,994,009 | A | 2/1991 | McEldowney | |
| 5,038,956 | A | 8/1991 | Saunders | |
| 5,042,284 | A | 8/1991 | Stodd et al. | |
| 5,149,238 | A | 9/1992 | McEldowney et al. | |
| D337,521 | S | 7/1993 | McNulty | |
| 5,331,836 | A | 7/1994 | Cudzik | |
| D352,898 | S | 11/1994 | Vacher | |
| 5,671,860 | A | 9/1997 | Louwerse et al. | |
| 5,685,189 | A | 11/1997 | Nguyen et al. | |
| 5,971,259 | A | 10/1999 | Bacon | |
| 6,004,089 | A | 12/1999 | Legresy et al. | |
| D421,907 | S | 3/2000 | Benge et al. | |
| 6,065,634 | A | 5/2000 | Brifcani et al. | |
| 6,079,249 | A | 6/2000 | Turner et al. | |
| 6,089,072 | A | 7/2000 | Fields | |
| 6,102,243 | A | 8/2000 | Fields et al. | |
| 6,460,723 | B2 | 10/2002 | Nguyen et al. | |
| 6,575,684 | B2 | 6/2003 | Heinicke et al. | |
| 6,666,933 | B2 | 12/2003 | Roberts et al. | |
| 6,688,832 | B1 | 2/2004 | Zysset | |
| 6,702,538 | B1 | 3/2004 | Heinicke et al. | |
| 6,848,875 | B2 | 2/2005 | Brifcani et al. | |
| 6,877,941 | B2 | 4/2005 | Brifcani et al. | |
| 6,935,826 | B2 | 8/2005 | Brifcani et al. | |
| D520,358 | S | 5/2006 | Heinicke | |
| 7,036,348 | B2 | 5/2006 | McClung | |
| 7,107,810 | B2 | 9/2006 | McClung | |
| 7,107,928 | B2 | 9/2006 | Chasteen et al. | |
| 7,124,613 | B1 | 10/2006 | McClung | |
| 7,143,623 | B1 | 12/2006 | Turnbull et al. | |
| 7,147,122 | B2 | 12/2006 | Heinicke | |
| 7,240,531 | B2 | 7/2007 | Turnbull et al. | |
| 7,270,246 | B2 | 9/2007 | Butcher et al. | |
| 7,302,822 | B1 | 12/2007 | Turnbull et al. | |
| 7,305,861 | B2 | 12/2007 | Turner et al. | |
| D565,406 | S * | 4/2008 | Foskett | D9/438 |
| D568,741 | S | 5/2008 | Foskett | |
| 7,370,774 | B2 | 5/2008 | Watson et al. | |
| 7,434,433 | B2 | 10/2008 | Holmes | |
| 7,472,575 | B2 | 1/2009 | Butcher et al. | |
| 7,478,550 | B2 | 1/2009 | Wynn et al. | |
| 7,493,790 | B2 | 2/2009 | Heinicke | |
| 7,500,376 | B2 | 3/2009 | Bathurst et al. | |
| 7,506,779 | B2 | 3/2009 | Jentzsch et al. | |
| 7,552,612 | B2 | 6/2009 | Heinicke | |
| D597,839 | S | 8/2009 | Stuart | |
| D600,117 | S | 9/2009 | Hall | |
| D600,118 | S | 9/2009 | Brehelin | |
| 7,591,392 | B2 | 9/2009 | Watson et al. | |
| 7,614,520 | B2 | 11/2009 | McEldowney et al. | |
| 7,677,404 | B2 | 3/2010 | McEldowney et al. | |
| 7,743,635 | B2 | 6/2010 | Jentzsch et al. | |
| 7,770,430 | B2 | 8/2010 | Miceli et al. | |
| 7,819,275 | B2 | 10/2010 | Stodd et al. | |
| D634,193 | S | 3/2011 | Draxler | |
| 7,922,025 | B2 | 4/2011 | Heinicke | |
| 7,938,290 | B2 | 5/2011 | Bulso | |
| 7,942,030 | B2 | 5/2011 | Miceli et al. | |
| RE42,485 | E | 6/2011 | Fields | |
| D650,276 | S | 12/2011 | Nesling et al. | |
| D650,278 | S | 12/2011 | Nesling et al. | |
| D653,109 | S | 1/2012 | Stammen | |
| 8,205,477 | B2 | 6/2012 | Jentzsch et al. | |
| 8,454,292 | B2 | 6/2013 | Saucedo et al. | |
| D685,266 | S | 7/2013 | Burleson, Jr. et al. | |
| D695,611 | S | 12/2013 | Burleson, Jr. et al. | |
| 2001/0037668 | A1 | 11/2001 | Fields | |
| 2004/0099665 | A1 | 5/2004 | McEldowney et al. | |
| 2005/0082291 | A1 | 4/2005 | Emmerzaal et al. | |
| 2007/0215620 | A1 | 9/2007 | Kasper | |
| 2008/0314906 | A1 | 12/2008 | Butcher et al. | |
| 2009/0212004 | A1* | 8/2009 | Metzger | B65D 7/04 215/382 |
| 2010/0059530 | A1 | 3/2010 | Niec et al. | |
| 2010/0108679 | A1 | 5/2010 | Leboucher | |
| 2010/0116374 | A1 | 5/2010 | Wilson et al. | |
| 2010/0126994 | A1 | 5/2010 | Tielbeke et al. | |
| 2010/0163560 | A1 | 7/2010 | Leboucher | |
| 2011/0006065 | A1 | 1/2011 | Leboucher et al. | |
| 2011/0303672 | A1* | 12/2011 | Fields | B21D 51/383 220/269 |
| 2012/0263835 | A1 | 10/2012 | Burleson, Jr. et al. | |
| 2013/0026169 | A1 | 1/2013 | Burleson, Jr. et al. | |

OTHER PUBLICATIONS

U.S. Appl. No. 29/493,411, filed Jun. 9, 2014, Burleson, Jr. et al.

* cited by examiner

CAN END WITH STRENGTHENING BEAD CONFIGURATION

CROSS-REFERENCE TO RELATED PATENT APPLICATIONS

This application is a continuation of U.S. application Ser. No. 13/531,060, titled "Can End with Strengthening Bead Configuration," filed Jun. 22, 2012, which is a continuation of U.S. application Ser. No. 13/249,527, titled "Can End with Strengthening Bead Configuration," filed Sep. 30, 2011, which is a continuation-in-part of U.S. Design application No. 29/398,281, titled "Can End," filed Jul. 28, 2011. U.S. application Ser. No. 13/531,060 is also a continuation-in-part of U.S. Design application No. 29/398,281, titled "Can End," filed Jul. 28, 2011, which is a continuation-in-part of U.S. Design application No. 29/377,154, titled "Can End," filed Oct. 18, 2010. U.S. application Ser. No. 13/531,060, U.S. application Ser. No. 13/249,527, U.S. Design application No. 29/398,281 and U.S. Design application No. 29/377,154 are incorporated herein by reference in their entireties.

BACKGROUND

The application generally relates to metal can ends. More specifically, the application relates to metal can ends that have a bead configuration that strengthens the can end. Can ends are used on can bodies with different dimensions that store a variety of materials, such as perishable food items. Can ends act to hermetically seal contents within the can and also provide an access point to the container contents.

SUMMARY OF INVENTION

One embodiment of the invention relates to a metal food can end configured to be coupled to a metal can body via a seam. The can end includes a curl section, a crown section, a wall section, a counter-sink section, a score track section, a frangible score, an outer downward bead, a first connecting section, an inner downward bead, a center panel and a tab. The curl section defines the outer circumference of the can end and terminates in a free edge. The curl section may be crimped with the metal can body end to form the seam. The crown section extends inward radially from the curl section. The wall section extends downward from the crown section. The counter-sink section includes an outer portion and an inner portion. The outer portion of the counter-sink extends downward from the wall section and the inner portion extends upward and radially inwards, away from the outer portion. The score track section extends radially inwards from the inner portion of the counter-sink section. The frangible score is formed from the material of the score track section. The score allows for separation of the portion of the can end located inside the score from the portion of the can end located outside the score. The outer downward bead extends radially inwards from the score track section and includes an outer portion and an inner portion. The outer portion extends downward and radially inwards away from the score track section. The inner portion extends upwards and radially inwards from the outer portion of the outer downward bead. The first connecting section extends radially inwards from the inner portion of the outer downward bead. The inner downward bead extends from the first connecting section. The inner downward bead includes an outer portion and an inner portion. The outer portion extends downward and radially inwards from the first connecting section. The inner portion extends upward and radially inwards from the outer portion of the inner downward bead. The center panel is located within the inner downward bead. The tab is moveable to break the score, allowing for the portion of the can end located inside the score to be separated from the portion of the can end located outside the score.

Another embodiment of the invention relates to a metal, food can, can end that includes a center panel, a bead panel, a counter-sink section, a wall and a curved section. Within the center panel is the center point of the can end. The bead panel is located radially outside the center panel and includes an inner upward bead, an inner downward bead, a central upward bead, an outer downward bead and an outer upward bead. The inner upward bead defines a first local maximum. The inner downward bead defines a first local minimum, and the first local minimum is located radially outside of the first local maximum. The central upward bead defines a second local maximum, and the second local maximum is located radially outside the first local minimum. The outer downward bead defines a second local minimum, and the second local minimum is located radially outside of the second local maximum. The outer upward bead defines a third local maximum, and the third local maximum is located radially outside the second local minimum. The counter-sink section is located radially outside of the bead panel and extends from the outer edge of the outer upward bead of the bead panel. The wall extends upward from the outer edge of the counter-sink section. The curved section extends radially outward from the upper edge of the wall and may be crimped to form a seam with the upper end of a metal can body.

An alternative embodiment of the invention relates to a metal can configured to hold a food product that includes a metal sidewall and a can end. The sidewall includes an upper end, a lower end and an inner surface defining an interior cavity. The can end is coupled to the upper end of the sidewall and includes a center panel, a bead panel, a counter-sink section, a wall and a curved section. Within the center panel is the center point of the can end. The bead panel is located radially outside the center panel and includes an inner upward bead, an inner downward bead, a central upward bead, an outer downward bead and an outer upward bead. The inner upward bead defines a first local maximum. The inner downward bead defines a first local minimum, and the first local minimum is located radially outside of the first local maximum. The central upward bead defines a second local maximum, and the second local maximum is located radially outside the first local minimum. The outer downward bead defines a second local minimum, and the second local minimum is located radially outside of the second local maximum. The outer upward bead defines a third local maximum, and the third local maximum is located radially outside the second local minimum. The counter-sink section is located radially outside of the bead panel and extends from the outer edge of the outer upward bead of the bead panel. The wall extends upward from the outer edge of the counter-sink section. The curved section extends radially outward from the upper edge of the wall and is crimped to form a seam with the upper end of the metal sidewall.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
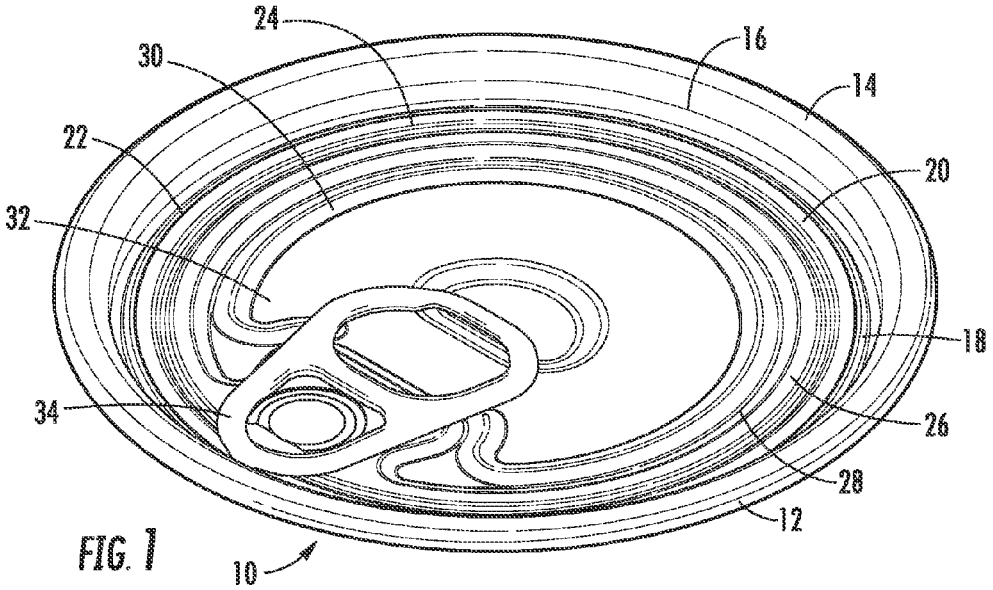
FIG. 1 is a perspective view from above of a metal can end having a bead configuration according to the exemplary embodiment.

Referring to FIG. 1, a can end 10 fabricated all, or in part, of metal (e.g., steel) has a configuration that strengthens the can end 10, increasing its resistance to deformation when placed in high pressure environments (e.g., food cooking process).

Figure 7:
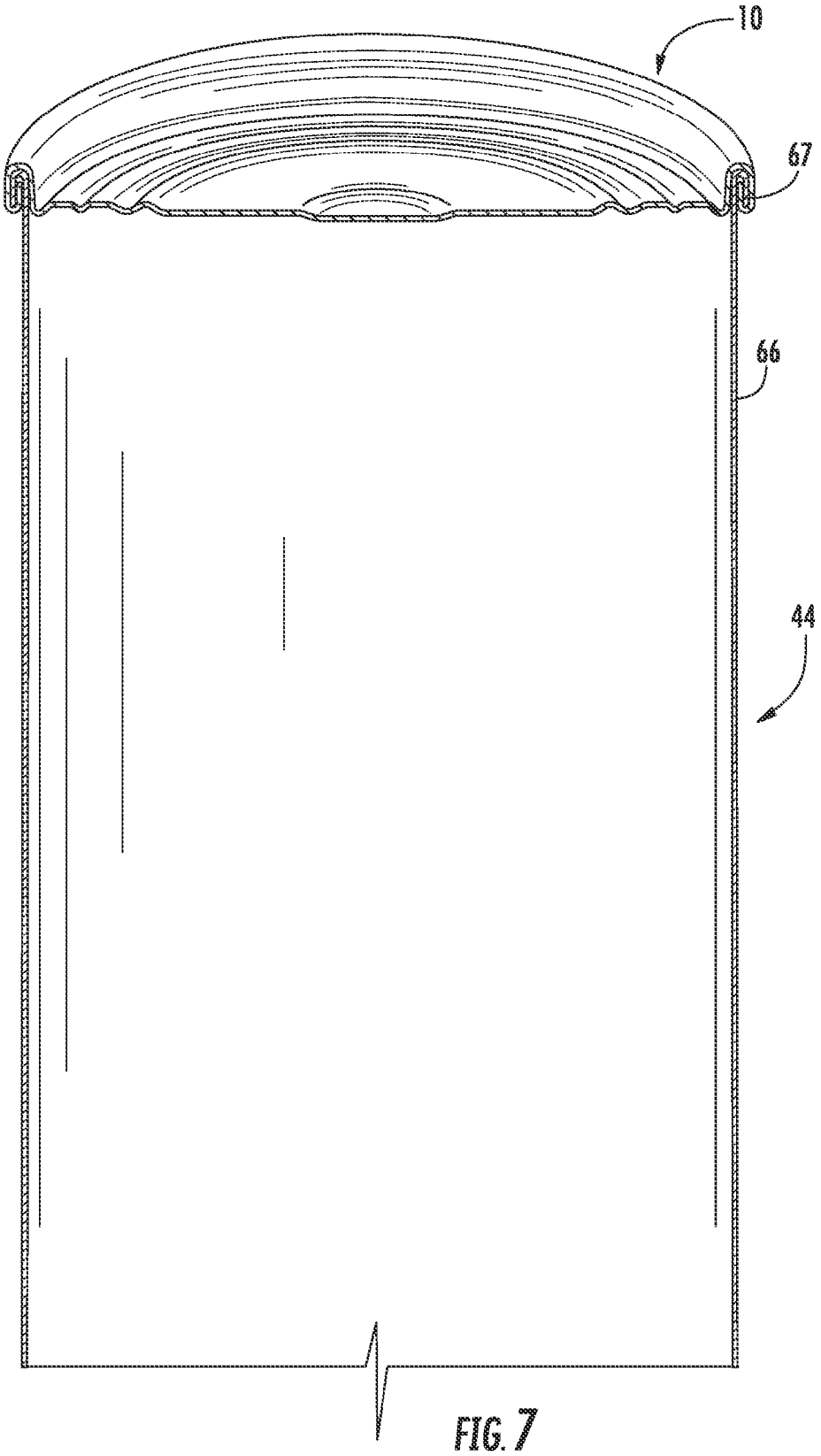
FIG. 7 is a perspective sectional view of a can end coupled to a can body via a seam according to an alternative embodiment.

Referring to FIG. 1, can end 10 includes a curl section 12, a crown section 14, a wall section 16, a counter-sink section 18, a score track section 20, a frangible score 22, an outer downward bead 24, a first connecting section 26, an inner downward bead 28, a second connecting section 30, a center panel 32 and a tab 34. Can end 10 is capable of distending under high internal pressure, but not so much that the can end 10 buckles, results in a distorted or "wavy" panel following cooking or in breakage of the can end portions located on the outside of the frangible score 22 from the portion located on the inside of the frangible score 22. Can end 10 is fabricated using double reduced steel with a thickness that is less than 75 gauge, more specifically less than 68 gauge. Thus, the strengthening configuration allows can end 10 to be made from thinner material than a can end without the strengthening configuration. Curl section 12 of can end 10 may be crimped to the can body 44 (shown in FIG. 7) via a seam formed by interlocking material of can end 10 and the upper end of can body 44, the can may be completely sealed by coupling a second can end to the can body with a second seam. When the two can ends are affixed to the top and bottom portions of the metal can body 44, as shown in FIG. 7, a cavity is formed. The cavity may contain various objects, substances, etc. The cavity of the exemplary embodiment of the metal can body 44 contains food.

Figure 2:
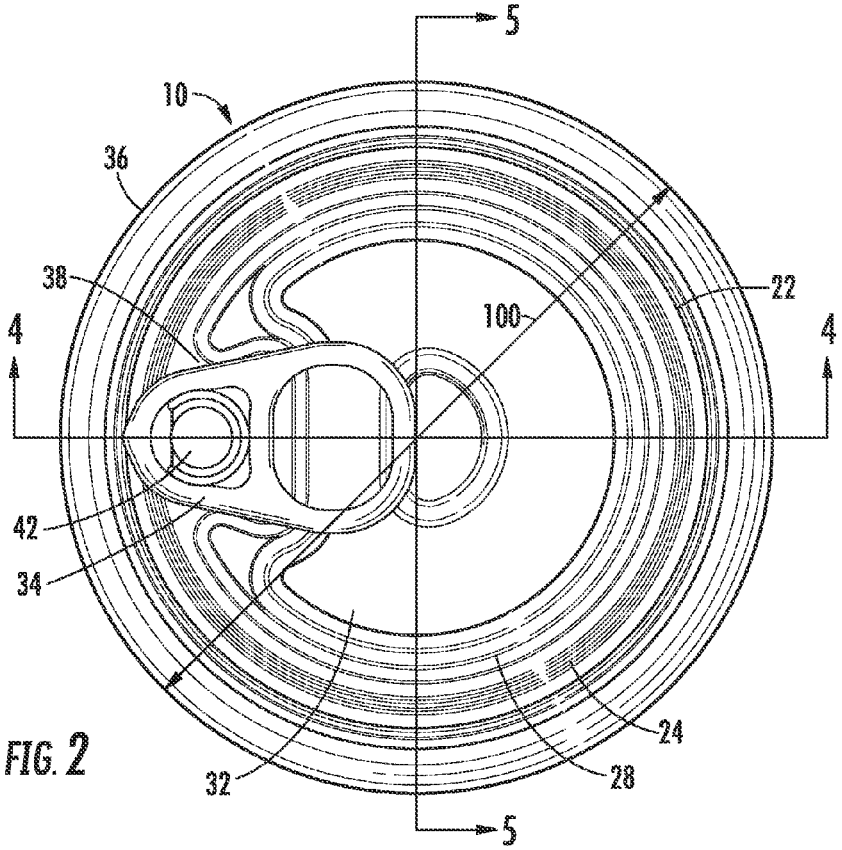
FIG. 2 is a top plan view of the can end of FIG. 1 according to an exemplary embodiment.
Figure 3:
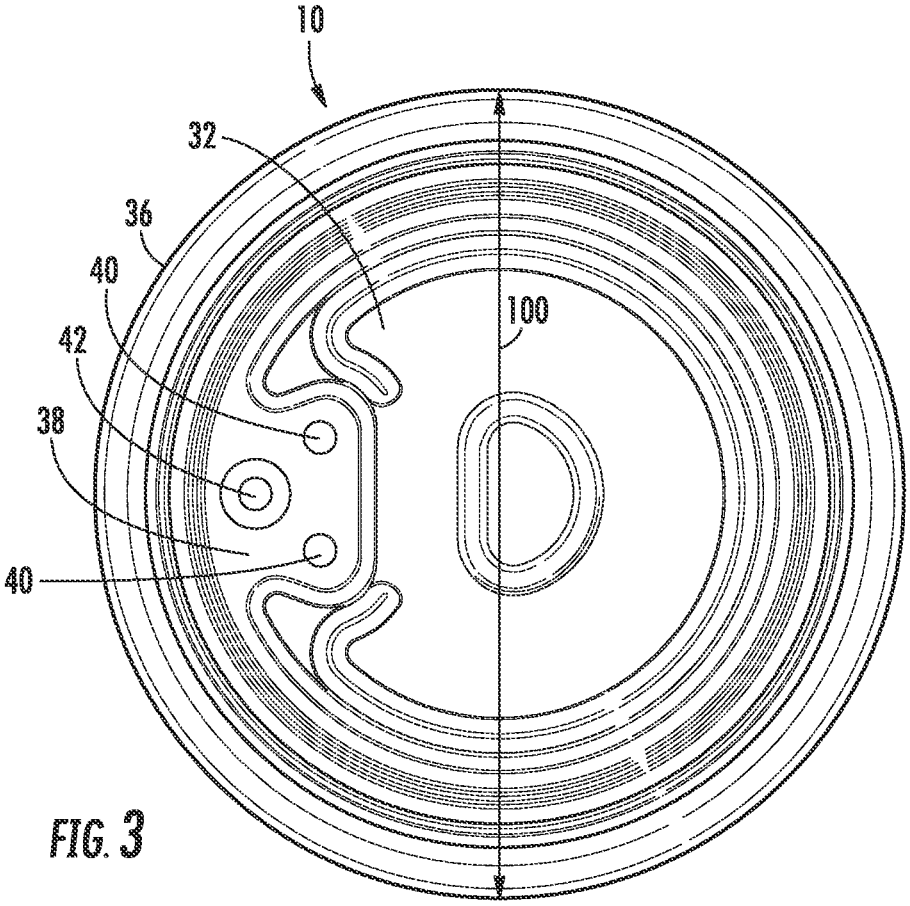
FIG. 3 is a bottom plan view of the can end of FIG. 1 according to an exemplary embodiment.

Referring to FIG. 2 and FIG. 3, can end 10 is generally circular in shape. Curl section 12 defines the outer circumference of can end 10 and terminates in an outer free edge 36. Outer downward bead 24 is a continuous bead that is concentric with the outer circumference of can end 10. Can end 10 has a total diameter 100 that may be between about 2.0 inches and 4.5 inches, specifically between 2.5 inches and 4.0 inches, more specifically, between 3.0 inches and 3.5 inches. In one exemplary embodiment, the total diameter 100 is about 3.25 inches.

Still referring to FIG. 2 and FIG. 3, can end 10 includes tab 34 (shown in FIG. 2) that is located on top of a mount 38 and support beads 40 (shown in FIG. 3). Tab 34 is fastened to can end 10 with a rivet head 42 (shown in FIG. 2). Mount 38 forms a horizontal plane that is higher than the horizontal plane formed by center panel 32. Located on the horizontal plane formed by mount 38 are two support beads 40 (shown in FIG. 3). Both support beads 40 assist in supporting a portion of tab 34. Tab 34 extends radially inwards, extending over both support beads 40 and the gripping portion of tab 34 further extends radially inwards suspended over a portion of center panel 32. During the manufacturing process, support beads 40 act as an alignment feature to facilitate correct alignment of can end 10.

Can end 10 has a 12 o'clock position, a 3 o'clock position, a 6 o'clock position and a 9 o'clock position that refer generally to the angular position of elements of can end 10. The 12 o'clock position is the position at which tab 34, mount 38, two support beads 40 and rivet head 42 are located. The 6 o'clock position refers to the area that is located 180° from the 12 o'clock position. The 3 o'clock and 9 o'clock positions are located 90° clockwise from the 12 o'clock and 6 o'clock positions, respectively.

Referring to FIG. 2, can end 10 includes a tab 34 that is capable of separating the portions of can end 10 located on either side of the frangible score 22 from each other. With score 22 broken, the portion of can end 10 located on the inside of score 22 may be separated from the portion of can end 10 located on the outside of score 22 creating an opening through can end 10 that allows for access to contents of the can.

Referring to FIG. 2, outer downward bead 24 and inner downward bead 28 are concentric with each other for at least 180° and less than 360° around can end 10, and in the embodiment shown, are concentric between the 3 o'clock and 9 o'clock positions passing through the 6 o'clock position. Specifically, outer downward bead 24 and inner downward bead 28 are concentric with each other for between about 180° and 359° around can end 10, and more specifically are concentric with each other for between about 190° and 300° around can end 10. The configuration of outer downward bead 24 and inner downward bead 28 act to strengthen the can end to resist deformation. Outer downward bead 24 and inner downward bead 28 in the exemplary embodiment are able to resist deformation when the pressure of the contents exceeds 20 pounds per square inch.

Figure 4A:
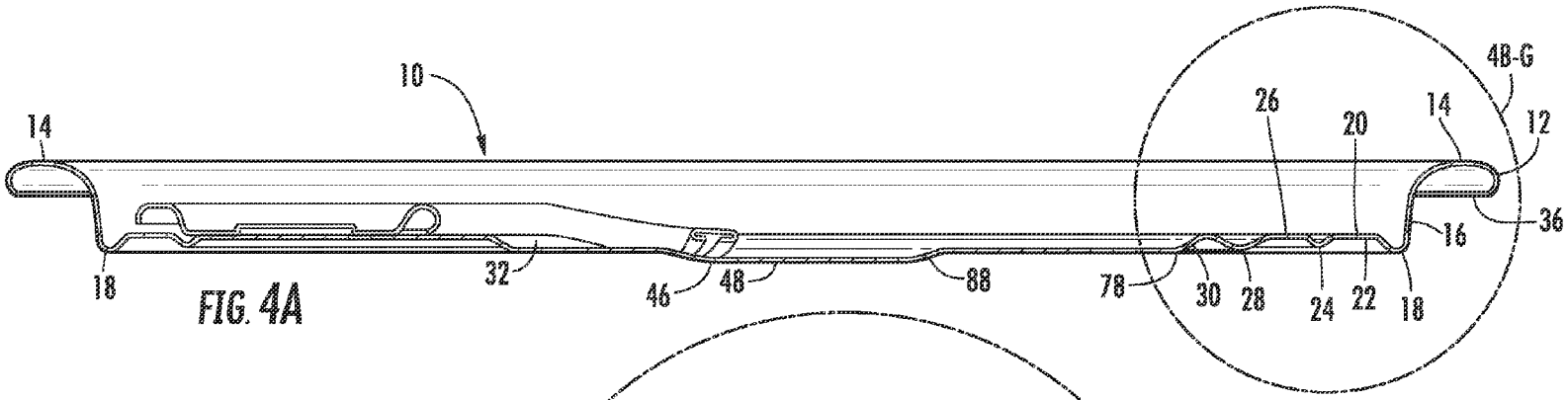
FIG. 4A is a sectional view of the can end of FIG. 1 taken along section line 4-4 in FIG. 2 according to an exemplary embodiment.

Referring to FIG. 4A, can end 10 has multiple ridges, transition areas and depressions that are adjacent to each other forming the strengthening configuration of can end 10. As shown, for example, in FIG. 1 and FIG. 4A, the strengthening configuration of can end 10 is located between center panel 32 and crown section 14 of can end 10. The ridges may be of various heights, but generally do not exceed the height of crown section 14. The depressions may also be of varying depths, but generally do not extend past the lowest portion of counter-sink section 18.

Figure 4B:
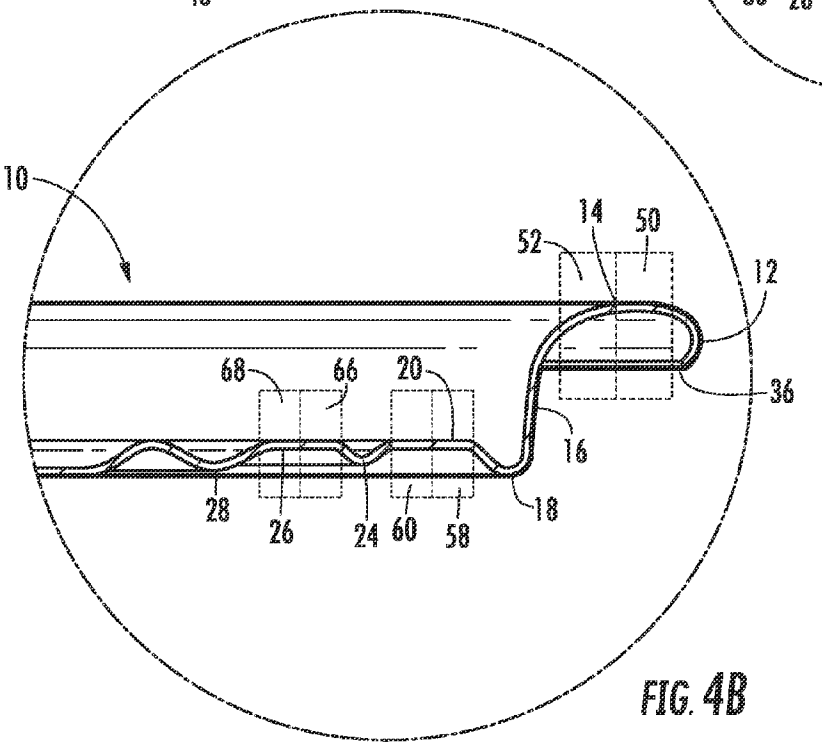
FIGS. 4B-G are detailed views of the area of the can end labeled as 4B-G in FIG. 4A according to an exemplary embodiment.
Figure 4C:
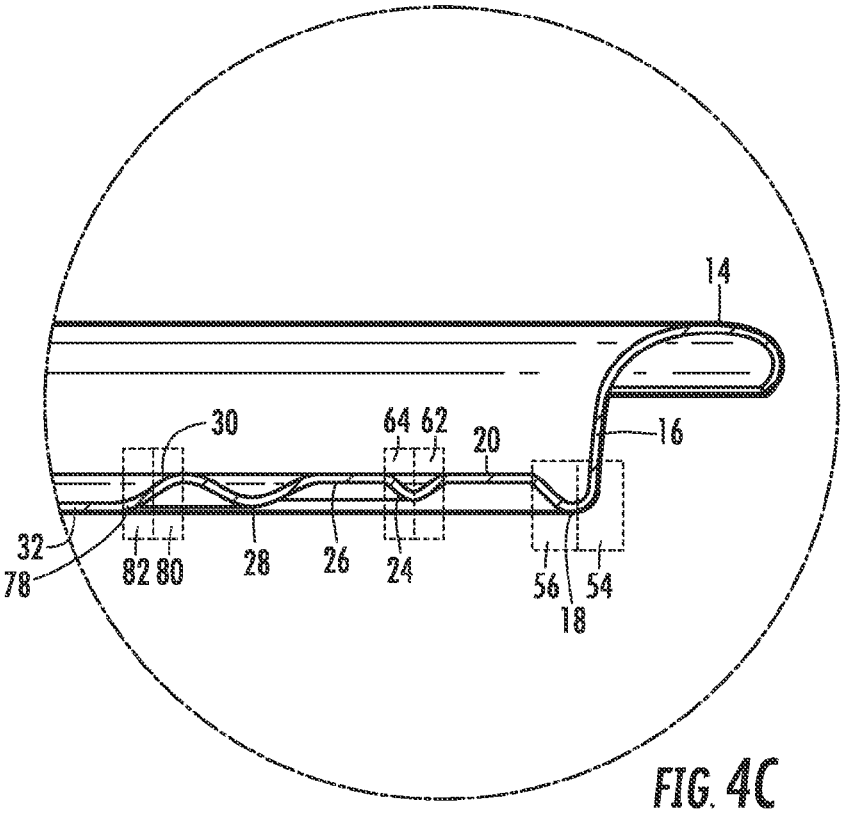
Figure 4D:
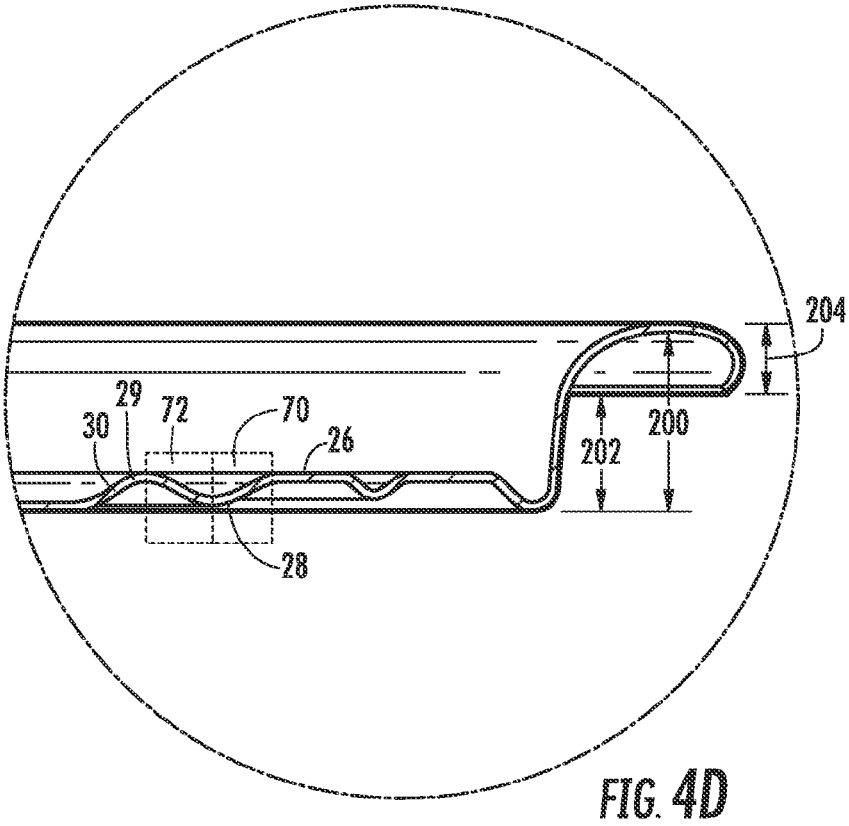

Referring to FIG. 4D, the total distance between the highest point of crown section 14 and the lowest point of counter-sink section 18 is referred to as the vertical distance 200. In the embodiment shown, vertical distance 200 is the maximum distance between the highest point of the can end 10 and the lowest point of the can end 10. In the exemplary embodiment shown, vertical distance 200 is about 0.190 inches. In alternative embodiments, vertical distance 200 is generally less than 0.220 inches, and, more specifically, is between about 0.190 inches and about 0.220 inches.

Referring to FIG. 4A and FIG. 4B, crown section 14 has an outer portion 50 and an inner portion 52 (outer portion 50 and inner portion 52 are the portions of crown 14 located within the labeled dotted line boxes in FIG. 4B). Crown section outer portion 50 is adjacent to curl section 12 and extends radially inwards from the curl section to crown section inner portion 52 that is adjacent to wall section 16. Crown section 14 includes the highest point on can end 10.

Figure 4E:
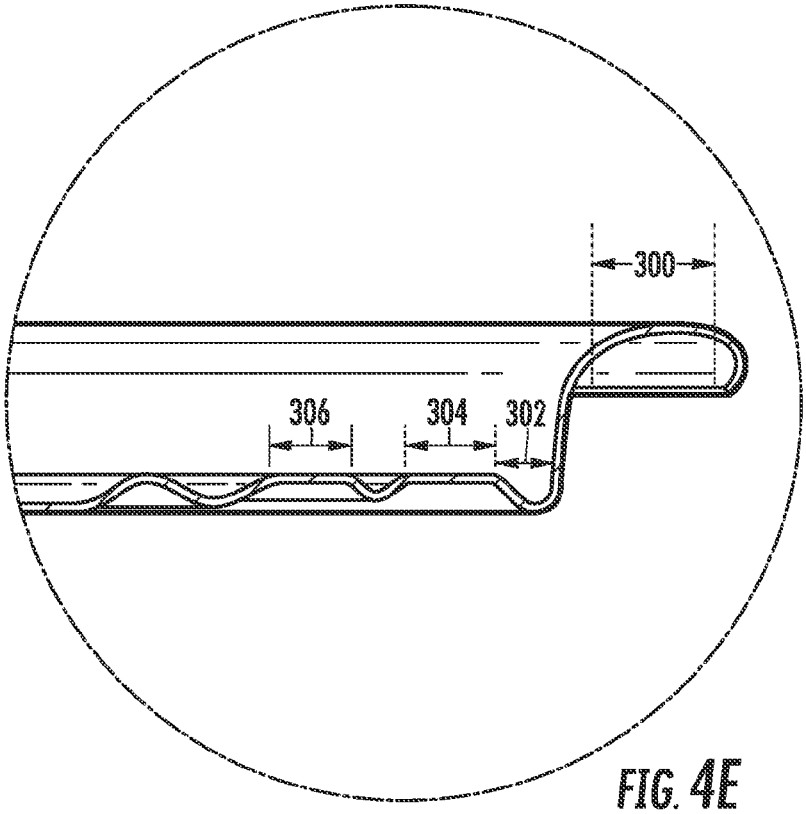

Referring to FIG. 4B and FIG. 4E, the size and configuration of crown section 14 and of curl section 12 are the same at all circumferential positions of can end 10. For example, the relative positioning of crown section 14 and curl section 12 is the same at all circumferential positions of can end 10. In addition, crown section 14 has a radial length 300 that is the same at all circumferential positions of can end 10. For example, in an exemplary embodiment, radial length 300 accounts for approximately 6.25% of total diameter 100 of can end 10. In other exemplary embodiments, radial length 300 generally accounts for less than 6.4% of total diameter 100 of can end 10, specifically accounts for between 6.0% and 6.4% of total diameter 100 of can end 10 and more specifically, accounts for between 6.15% and 6.28% of total diameter 100 of can end 10.

As shown in FIG. 4A, FIG. 4B and FIG. 4D, wall section 16 extends downwardly from crown section inner portion 52 to the counter-sink section 18. The length of wall section 16 (i.e., the length of the material extending downward from the crown section 14 to the counter-sink section 18) is the same length throughout the entire circumference of can end 10. The wall vertical distance 202, shown in FIG. 4D, is the vertical distance between free edge 36 and the lower most portion of counter-sink 18. The curl vertical distance 204 is the vertical distance from free edge 36 to the highest portion of crown section 14. As shown in FIG. 4D, wall vertical distance 202 is greater than curl vertical distance 204 and less than total vertical distance 200.

In an exemplary embodiment, total vertical distance 200 is about 0.190 inches, and curl vertical distance 204 is about 0.073 inches. In such embodiments, wall vertical distance 202 is less than 0.190 inches and is greater than 0.073 inches, and in one specific embodiment, wall vertical distance 202 is about 0.117 inches. In various embodiments, wall section 16 may be of various lengths, resulting in different wall vertical distances 202. In one exemplary embodiment, vertical distance 200 is about 0.220 inches and curl vertical distance 204 is about 0.084 inches, and wall vertical distance 202 is between about 0.220 inches and 0.084 inches, and more specifically may be about 0.136 inches.

Referring to FIG. 4A and FIG. 4C, counter-sink section 18 has an outer portion 54 that extends downward and radially inwards from wall section 16 and an inner portion 56 that extends upward and radially inwards away from the outer portion 54 and towards score track section 20 (outer portion 54 and inner portion 56 are the portions of counter-sink section 18 located within the labeled dotted line boxes in FIG. 4C). The size and configuration of crown section 14 and of counter-sink section 18 are the same at all circumferential positions of can end 10. For example, the relative positioning of crown section 14 and counter-sink section 18 is the same at all circumferential positions of can end 10.

Referring to FIG. 4C and FIG. 4E, the size and configuration of counter-sink section 18 is the same at all circumferential positions of can end 10. For example, the relative positioning of counter-sink section 18 is the same at all circumferential positions of can end 10. In addition, counter-sink section 18 has a radial length 302 that is the same at all circumferential positions of can end 10. For example, in an exemplary embodiment, radial length 302 accounts for approximately 0.37% of total diameter 100 of can end 10. In alternative embodiments, radial length 302 generally accounts for less than 0.61% of total diameter 100 of can end 10, and more specifically, accounts for between 0.18% and 0.50% of total diameter of can end 10.

Referring to FIG. 4A, FIG. 4B and FIG. 4E, score track section 20 extends radially inward from counter-sink section inner portion 56. Score track section 20 is substantially horizontal defining a substantially horizontal plane with a radial length 304 that has an outer portion 58 that is adjacent to the inner portion 56 of counter-sink section 18, an inner portion 60 that is adjacent to outer downward bead 24 (outer portion 58 and inner portion 60 are the portions of score track section 20 located within the labeled dotted line boxes in FIG. 4B). Frangible score 22 (shown in FIG. 4A) is located within score track section 20 and is formed out of the material of score track section 20. Counter-sink section inner portion 56 extends radially inwards and upwards to score track section outer portion 58. Frangible score 22 is located at the same radial position at all circumferential positions within score track section 20 of can end 10. The size and configuration of score track section 20 are the same at all circumferential positions of can end 10. For example, the relative positioning of score track section 20 is the same at all circumferential positions of can end 10. Frangible score 22 extends throughout the entire circumference of the can end 10 and allows for the can end 10 portion located on the outside of frangible score 22 to separate from the can end 10 portion located on the inside of frangible score 22. The separation of can end 10 along frangible score 22 allows the user to access the contents of the cavity of can body 44 (shown in FIG. 7). In the exemplary embodiment, the separation of can end 10 may be achieved by manually pulling on a pull tab.

Figure 5:
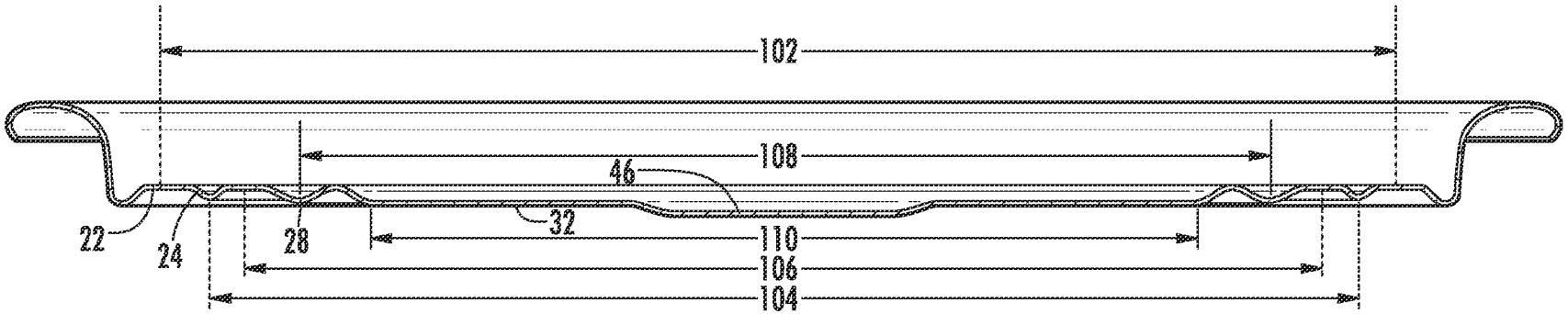
FIG. 5 is a sectional view of the can end of FIG. 1 taken along section line 5-5 in FIG. 2 according to an exemplary embodiment.

Referring to FIG. 5, score track section 20 has a diameter 102 measured at the location of frangible score 22. In an exemplary embodiment, diameter 102 is between about 2.632 inches and 2.652 inches, and specifically is between about 2.637 inches and 2.647 inches. For example, diameter 102 of score track section 20 from a point along frangible score 22 in the 3 o'clock position, passing through center point 46 of can end 10, to a point along frangible score 22 in the 9 o'clock position in the exemplary embodiment is between about 2.637 inches and 2.647 inches, and specifically is about 2.642 inches. In various embodiments, diameter 102 is between 78% and 86% of total diameter 100, specifically is between 80% and 84% of total diameter 100, and more specifically is about 82% of total diameter 100 of can end 10.

Referring to FIG. 4C, outer downward bead 24 has an outer portion 62 that extends downward and radially inwards from score track section 20 and an inner portion 64 that is adjacent to first connecting section 26. Outer portion 62 of outer downward bead 24 extends downward and radially inward from score track section 20. Inner portion 64 of outer downward bead 24 extends upward and radially inward from outer portion of the outer downward bead 24. The size and configuration of outer downward bead 24 are the same at all circumferential positions of can end 10. For example, the relative positioning of outer downward bead 24 is the same at all circumferential positions of can end 10.

Referring to FIG. 4A, the lowest point of outer downward bead 24 does not extend beyond the depth of counter-sink 18. Outer downward bead 24 has a first vertical distance between the horizontal plane formed by score track section 20 and the lowest point of outer downward bead 24 at the 6 o'clock position and a second vertical distance between the horizontal plane formed by score track section 20 and the lowest point of outer downward bead 24 at the 12 o'clock position. In the exemplary embodiment, the vertical distance at the 6 o'clock position is between about 0.004 inches and about 0.010 inches and the vertical distance at the 12 o'clock position is between about 0.010 and about 0.016 inches.

Referring to FIG. 5, outer downward bead 24 has a diameter 104 that is measured between opposing radial center points of bead 24 (e.g., the lowest points of bead 24 shown in FIG. 5). For example, diameter 104 of outer downward bead 24 is the distance from the lowest point in the 3 o'clock position, passing through center point 46 of can end 10, to the lowest point in the 9 o'clock position. In various exemplary embodiments, diameter 104 is between about 2.435 inches and 2.445 inches, and specifically is about 2.440 inches. In various embodiments, diameter 104 is between 70% and 80% of total diameter 100, specifically between 73% and 77% of total diameter 100, more specifically is about 75% of total diameter 100 of can end 10. The dimensions of outer downward bead 24 may be of varying lengths and depths in alternative embodiments of can end 10.

Referring to FIG. 4A, FIG. 4B and FIG. 4E, first connecting section 26 extends radially inwards from outer downward bead inner portion 64 and has an outer portion 66 that is directly coupled to outer downward bead 24 and an inner portion 68 that is directly coupled to inner downward bead 28 (outer portion 66 and inner portion 68 are the portions of first connecting section 26 located within the labeled dotted line boxes in FIG. 4B). First connecting section 26 defines a substantially horizontal plane having an radial length 306. The horizontal plane formed by score track section 20 can either be slightly higher, the same as or lower than the horizontal plane formed by first connecting section 26. The horizontal plane formed by score track section 20 may be higher than the horizontal plane formed by first connecting section 26, resulting in a vertical distance between the two horizontal planes of about 0.000 inches and 0.014 inches. The horizontal plane formed by score track section 20 may also be lower than the horizontal plane formed by first connecting section 26, resulting in a vertical distance between the two horizontal planes of about 0.000 inches and 0.006 inches. The radial length 306 of first connecting section 26 remains constant for at least 180° around can end 10, and specifically radial length 306 remains constant for between 180° and 359° around can end 10. More specifically, radial length 306 remains constant for between 190° and 300° of can end 10 between the 3 o'clock and 9 o'clock positions that includes the 6 o'clock position. Near the 12 o'clock position of can end 10, first connecting section 26 and mount 38 are in the same general horizontal plane.

Referring to FIG. 5, first connecting section 26 has a diameter 106 that is the distance measured between opposing mid-points of first connecting section 26. As shown, diameter 106 is less than diameter 104 of outer downward bead 24. In various embodiments, diameter 106 is between about 2.294 inches and 2.314 inches, and more specifically is between about 2.299 inches and 2.309 inches. For example, diameter 106 of first connecting section 26 from a point in the 3 o'clock position, passing through center point 46 of can end 10, to a point in the 9 o'clock position is between about 2.299 inches and 2.309 inches, and specifically is about 2.304 inches. In various embodiments, diameter 106 of first connecting section 26 is between 66% and 74% of total diameter 100, specifically between 68% and 72% of total diameter 100, and more specifically is about 70% of total diameter 100 of can end 10.

Figure 6:
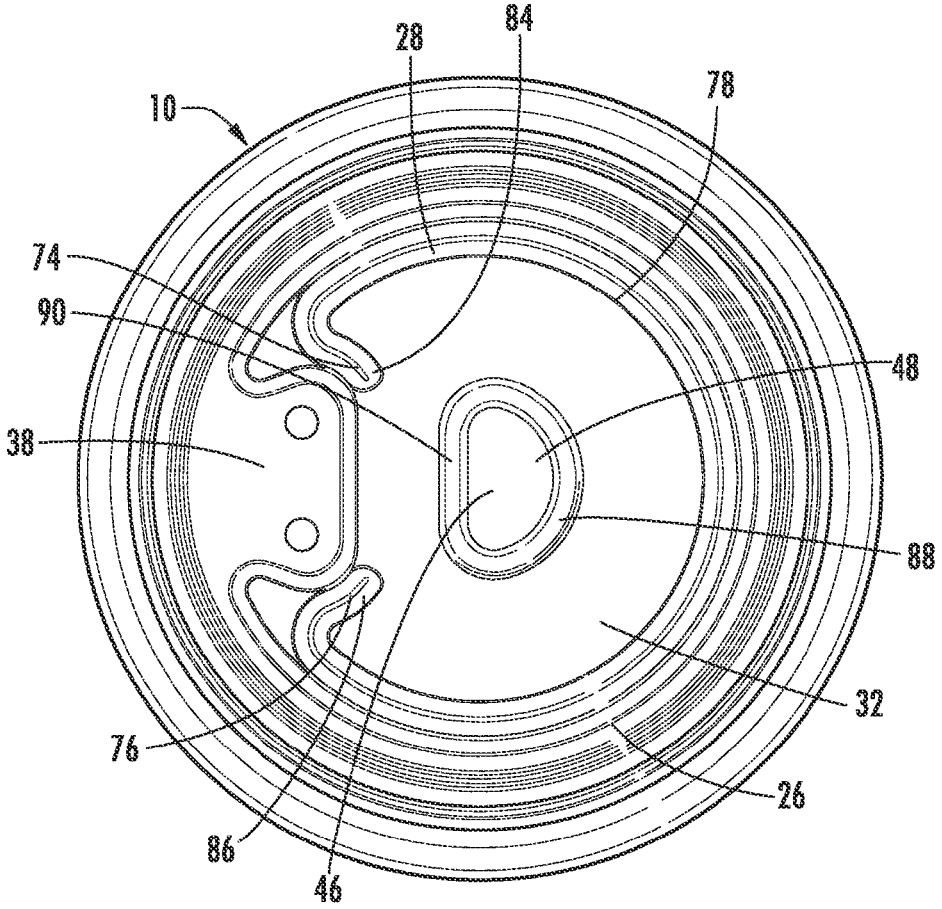
FIG. 6 is a top plan view of a can end according to another exemplary embodiment.

Referring to FIG. 4A, FIG. 4D and FIG. 6, inner downward bead 28 includes an outer portion 70 that extends downward and radially inward from first connecting section 26 and an inner portion 72 extending upward and radially inward from the outer portion 70 (outer portion 70 and inner portion 72 of inner downward bead 28 are the portions of inner downward bead 28 located within the labeled dotted line boxes in FIG. 4D). Outer portion 70 is adjacent to first connecting section 26 and inner portion 72 is adjacent to second connecting section 30. Referring to FIG. 6, inner downward bead 28 is a non-continuous bead that extends around a portion of can end 10, extending from a first end 74 located on one side of mount 38 and one side of tab 34 to a second end 76 located on the opposite lateral side of mount 38 and the opposite lateral side of tab 34 from first end 74. Inner downward bead 28 terminates at first end 74 and second end 76 located on each lateral side of mount 38. Specifically, inner downward bead 28 and first connecting section 26 are concentric with each other for at least 180°, specifically are concentric with each other for between about 180° and 359° around can end 10, and more specifically are concentric with each other for between about 190° and 300° around can end 10.

Referring back to FIG. 4A, the vertical position of the lowest point of inner downward bead 28 is located between lowest points of counter-sink section 18 and outer downward bead 24. The inner downward bead vertical distance is the vertical distance measured from the lowest point of the inner downward bead 28 and the horizontal plane formed by the score track section 20. In the exemplary embodiment, the vertical distance between inner downward bead 28 and score track section 20 is between about 0.017 inches and 0.027 inches, specifically between about 0.020 inches and 0.024 inches, more specifically about 0.022 inches.

Referring to FIG. 5, inner downward bead 28 has a diameter 108 that is the distance measured between opposing radial center points of bead 28 (e.g., the lowest points of bead 28 shown in FIG. 5). As shown, diameter 108 is less than diameter 104 of outer downward bead 24 and diameter 106 of first connecting section 26. In various embodiments, diameter 108 is between about 2.080 inches and 2.100 inches, and more specifically is between about 2.085 inches and 2.095 inches. For example, diameter 108 of inner downward bead 28 from a point in the 3 o'clock position, passing through center point 46 of can end 10, to a point in the 9 o'clock position is between about 2.085 inches and 2.095 inches, and specifically is about 2.090 inches. In various embodiments, diameter 108 of inner downward bead 28 is between 60% and 68% of total diameter 100, specifically between 62% and 66% of total diameter 100, and more specifically is about 64% of total diameter 100 of can end 10.

Referring to FIG. 4A, FIG. 4C and FIG. 6, second connecting section 30 has an outer portion 80 that extends downward and radially inward from inner downward bead 28 and an inner portion 82 that joins to the outer edge 78 of center panel 32 (outer portion 80 and inner portion 82 of second connecting section 30 are located within the dotted line boxes of FIG. 4C). Second connecting section 30 extends around a portion of can end 10, extending from a first end 84 located on one side of mount 38 to a second end 86 located on the opposite lateral side of mount 38 from first end 84. Outer portion 80 is adjacent to inner downward bead 28 and inner portion 82 is adjacent to center panel 32. As shown in FIG. 6, first end 84 and second end 86 of second connecting section 30 are located near the 12 o'clock position. Second connecting section 30 and inner downward bead 28 are concentric with each other for at least 180° around can end 10, specifically are concentric with each other for between about 180° and 359° around can end 10, and more specifically are concentric with each other for between about 190° and 300° around can end 10.

Together, outer portion 72 of inner downward bead 28 and second connecting section 30 form an inner upward bead 29, shown in FIG. 4D. The highest point of inner upward bead 29 is slightly higher than the horizontal plane formed by score track section 20, resulting in a vertical distance between the highest point of inner upward bead 29 and score track section 20 that is between 0.001 inches and 0.012 inches. For example, the vertical distance between the highest point of inner upward bead 29 and score track section 20 in the exemplary embodiment is 0.0065 inches.

Referring to FIG. 5, center panel 32 has a diameter 110 measured from outer most edge 78 of center panel 32. In various embodiments, diameter 110 is between about 1.780 inches and 1.800 inches, and specifically is between about 1.785 and 1.795 inches. For example, diameter 110 of center panel 32 from a point at outer most edge 78 in the 3 o'clock position, passing through center point 46 of can end 10, to a point at outer most edge 78 in the 9 o'clock position is between about 1.785 inches and 1.795 inches, and more specifically is about 1.790 inches. In various embodiments, diameter 110 of center panel 32 is between 50% and 60% of total diameter 100, specifically is between 53% and 57% of total diameter 100, more specifically is about 55% of total diameter 100 of can end 10.

Referring to FIG. 4A and FIG. 6, center panel 32 has a transition area 88 sloping downward and radially inwards toward a center depression 48. Center depression 48 may be formed in various shapes (i.e., a circle, rectangle, oval, etc.) and includes center point 46 of can end 10. The exemplary embodiment of can end 10 shown has center depression 48 that is in the general shape of the letter "D". The straight line portion 90 of the letter "D" (shown in FIG. 6) faces or is parallel to the 12 o'clock position of can end 10 and extends in the direction from the 3 o'clock to 9 o'clock position, and the curved portion of the "D" shape faces towards the 6 o'clock position to form a complete "D" shape. The gripping portion of tab 34 is located above center depression 48. Center depression 48 acts as a finger well facilitating a user to access the gripping portion of tab 34.

Referring generally to can end 10, the radial distance between center point 46 and the inner most edge of inner downward bead 28 is greater than half of the total radius of can end 10. For example, if the total radius of can end 10 is 2.0 inches, then the radial distance between center point 46 and the inner portion of inner downward bead 28 can be any distance between 1.0 inch and 2.0 inches.

Referring generally to can end 10, score track section 20, outer downward bead 24, first connecting section 26, inner downward bead 28, second connecting section 30, and center panel 32 are configured to strengthen can end 10. In particular, the various positions, shapes, sizes, etc. of the structure of can end 10 described herein provide can end 10 with improved strength and/or deformation resistance.

Figure 4F:
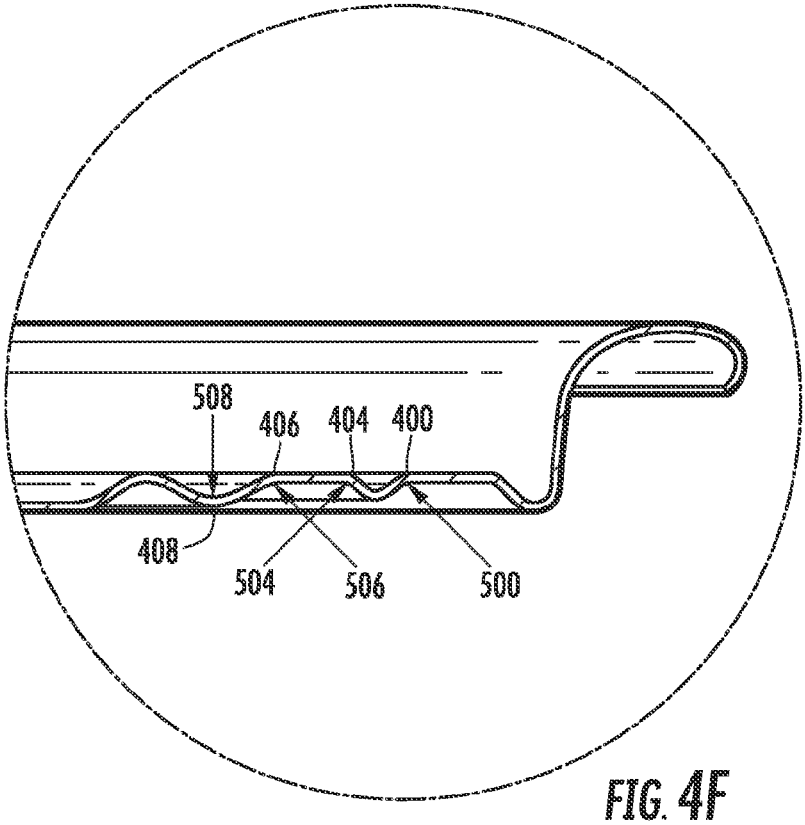

Referring to FIG. 4F, can end 10 includes a number of curved transition areas located between various structures discussed above. The first curved transition area 400 connects score track section 20 and outer downward bead outer portion 62. In the exemplary embodiment, the lower surface of first curved transition area 400 has a radius of curvature 500 that is between about 0.015 inches and 0.025 inches, and more specifically is about 0.020 inches.

Figure 4G:
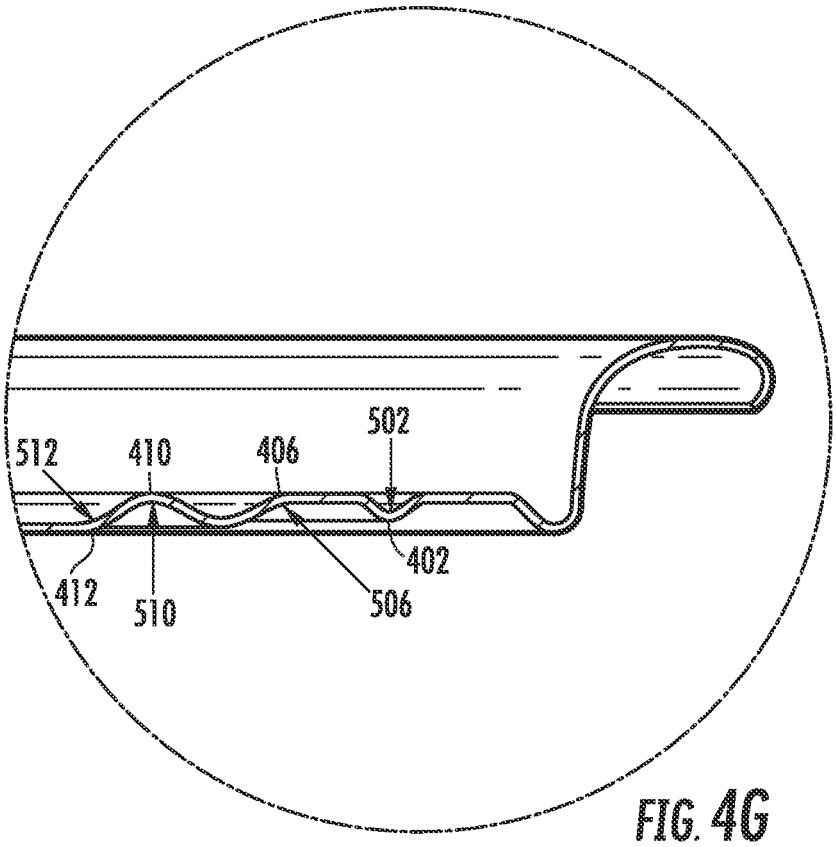

Referring to FIG. 4F and FIG. 4G, from first curved transition area 400, outer downward bead outer portion 62 extends downward and radially inwards towards the second curved transition area 402. Second curved transition area 402 is between outer downward bead outer portion 62 and outer downward bead inner portion 64. The lowest point of outer downward bead 24 is located in second curved transition area 402. In the exemplary embodiment, the upper surface of second curved transition area 402 has a radius of curvature 502 that is between about 0.010 inches and 0.020 inches, and more specifically is about 0.015 inches.

Referring to FIG. 4F, the third curved transition area 404 connects outer downward bead inner portion 64 and first connecting section 26. In the exemplary embodiment, the lower surface of third curved transition area 404 has a radius of curvature 504 that is between about 0.015 inches and 0.025 inches, and more specifically is about 0.020 inches.

Referring to FIG. 4G, the fourth curved transition area 406 connects first connecting section 26 and inner downward bead outer portion 70. In the exemplary embodiment, the lower surface of fourth curved transition area 406 has a radius of curvature 506 that is between about 0.019 inches and 0.029 inches, more specifically about 0.024 inches.

Referring to FIG. 4F, from fourth curved transition area 406, inner downward bead outer portion 70 extends downward and radially inwards towards the fifth curved transition area 408. Fifth curved transition area 408 connects inner downward bead outer portion 70 and inner downward bead inner portion 72 and contains the lowest point of inner downward bead 28. In the exemplary embodiment, the upper surface of fifth curved transition area 408 has a radius of curvature 508 that is between about 0.019 inches and 0.029 inches, and more specifically is about 0.024 inches. Fifth curved transition area 408 continues to extend upward and radially inwards towards inner downward bead inner portion 72.

Referring to FIG. 4G, the sixth curved transition area 410 connects inner downward bead inner portion 72 to second connecting section 30. In the exemplary embodiment, the lower surface of sixth curved transition area 410 has a radius of curvature 510 that is between about 0.019 inches and 0.029 inches, more specifically about 0.024 inches. The seventh curved transition area 412 connects second connecting section 30 to center panel 32. In the exemplary embodiment the upper surface of seventh curved transition area 412 has a radius of curvature 512 that is between about 0.019 inches and 0.029 inches, more specifically 0.024 inches.

Referring to FIG. 7, a perspective, sectional view, of a can end 10 and can body 44 is shown according to an exemplary embodiment. As shown in FIG. 7, can end 10 is coupled to a side wall 66 via a seam 67 formed by interlocking material of the upper end of side wall 66 of can body 44 and can end 10.

Can ends discussed herein may include can ends of any style, shape, size, etc. For example, the can ends discussed herein may be shaped such that the outer perimeter of the can end is generally circular. However, in other embodiments the can ends discussed herein may be shaped in a variety of ways (e.g., rectangular, square, polygonal, hexagonal, octagonal, oval, elliptical, etc.) as may be desirable for different applications or aesthetic reasons. Can ends may have various diameters or widths (e.g., 2 inches, 3 inches, 5 inches, etc.) as desired for a particular application.

The can ends discussed are shown, in FIG. 7, coupled a can body via a "double seam" formed from the interlocked portions of material of the can sidewall and the can end. However, in other embodiments, the can ends discussed herein may be coupled to the sidewall via other mechanisms. For example, can ends may be coupled to the sidewall via welds or solders.

The can ends discussed herein may be used to hold perishable materials (e.g., food). It should be understood that the phrase "food" used to describe various embodiments of this disclosure may refer to dry food, moist food, powder, liquid, or any other drinkable or edible material, regardless of nutritional value. In other embodiments, the can ends discussed herein may be on containers used to hold non-perishable materials or non-food materials. In various embodiments, the can ends discussed herein may be on containers that the product is packed in liquid that is drained from the product prior to use. For example, the containers discussed herein may contain vegetables, pasta or meats packed in a liquid such as water, brine, or oil.

According to various exemplary embodiments, the inner surfaces of the can ends and the can body sidewall may include a liner (e.g., an insert, coating, lining, a protective coating, sealant, etc.). The protective coating acts to protect the material of the container from degradation that may be caused by the contents of the container. In an exemplary embodiment, the protective coating may be a coating that may be applied via spraying or any other suitable method. Different coatings may be provided for different food applications. For example, the liner or coating may be selected to protect the material of the container from acidic contents, such as carbonated beverages, tomatoes, tomato pastes/sauces, etc. The coating material may be a vinyl, polyester, epoxy, EVOH and/or other suitable lining material or spray. The interior surfaces of the container ends may also be coated with a protective coating as described above.

It should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Other substitutions, modifications, changes and omissions may also be made in the design, operating conditions and arrangement of the various exemplary embodiments without departing from the scope of the present invention.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A metal, food can, can end comprising:

a center panel, wherein a center point of the can end is located within the center panel;

a bead panel located radially outside of the center panel, the bead panel comprising:

an inner downward bead defining a first low point;

an outer downward bead defining a second low point, the outer downward bead located radially outside of the inner downward bead; and a first connector section extending between the inner downward bead and the outer downward bead, the first low point and the second low point each being vertically below a lowermost surface of the first connector section;

a counter-sink section located radially outside of the bead panel;

a wall extending upward from an outer edge of the counter-sink section;

a curled section extending radially outward from an upper edge of the wall, wherein the curled section is configured to be crimped with an upper end of a metal can body to form a seam; and a tab, wherein the outer downward bead is a continuous bead that is concentric with the outer circumference of the can end, and further wherein the inner downward bead is a non-continuous bead having a first end and a second end, the ends positioned on opposing lateral sides of the tab.

2. The metal can end of claim 1, the bead panel further comprising:

an inner upward bead defining a first high point, the first low point located radially outside of the first high point;

a central upward bead defining a second high point, the second high point located radially outside of the first low point; and an outer upward bead defining a third high point, the third high point located radially outside of the second low point.

3. The metal can end of claim 2, further comprising:

a frangible score formed in the material of the outer upward bead;

wherein the tab is configured to pivot to break the score allowing a portion of the can end located within the score to separate from a portion of the can end located outside of the score.

4. The metal can end of claim 3, further comprising a depression located within the center panel, wherein the tab comprises a gripping portion located above the depression, wherein the depression acts as a finger well facilitating user access to the gripping portion of the tab.

5. The metal can end of claim 2, wherein a radial distance from the center point of the can end to an innermost edge of the inner downward bead is greater than half of the radius of the can end.

6. The metal can end of claim 5, wherein a diameter of an outermost edge of the center panel is between 1.795 inches and 1.785 inches, wherein a diameter of the inner downward bead measured between opposing first low points is between 2.095 and 2.085 inches, and wherein a diameter of the outer downward bead measured between opposing second low points of the outer downward bead is between 2.445 and 2.435 inches.

7. The metal can end of claim 6, wherein a diameter of the outer upward bead measured between opposing third high points is between 2.647 and 2.637 inches.

8. The metal can end of claim 2:

wherein the first low point is vertically below the third high point;

wherein a vertical distance between the first low point and the third high point is between 0.027 and 0.017 inches;

wherein the second low point is vertically below the third high point;

wherein a vertical distance between the second low point and the third high point is between 0.010 and 0.004 inches;

wherein the first high point is vertically below the third high point;

wherein a vertical distance between the first high point and the third high point is between 0.012 and 0.001 inches;

wherein the second high point is between 0.000 and 0.014 inches vertically below the third high point or between 0.000 and 0.006 inches vertically above the third high point.

9. The metal can end of claim 2, wherein the tab is located at a 12 o'clock position on the can end, wherein at a 6 o'clock position, a vertical distance between the second low point and the third high point is between 0.01 and 0.004 inches, and wherein at the 12 o'clock position, a vertical distance between the second low point and the third high point is between 0.016 and 0.010.

10. The metal can end of claim 1:

wherein the inner downward bead comprises a first curved section defining the first low point;

wherein the outer downward bead comprises a second curved section defining the second low point;

wherein a radius of curvature of the upper surface of the first curved section is between 0.029 and 0.019 inches; and wherein a radius of curvature of the upper surface of the second curved section is between 0.020 and 0.010 inches.

11. The metal can end of claim 1, wherein the inner downward bead is concentric with the outer downward bead for at least 180 degrees and less than 360 degrees of the can end.

12. The metal can end of claim 11, the can end being attached to a metal can body containing contents, wherein the inner downward bead and the outer downward bead are configured to strengthen the can end to resist deformation that may occur when the pressure of the contents of the metal can body exceeds 20 pounds per square inch.

13. The metal can end of claim 12, wherein the can end is formed of double reduced steel with a thickness less than or equal to 68 gauge.

14. The metal can end of claim 13, wherein a vertical distance between an uppermost surface of the curled section and a lowermost surface of the counter-sink section is less than or equal to 0.190 inches.

15. The metal can end of claim 12, wherein the can end is formed of double reduced steel with a thickness less than 75 gauge.

16. The metal can end of claim 15, wherein a vertical distance between an uppermost surface of the curled section and a lowermost surface of the counter-sink section is less than 0.220 inches.

17. The metal can end of claim 1 coupled to a metal can body via the seam.

18. The metal can end of claim 1 coupled to one end of a metal can body via the seam, wherein a second can end is coupled to the other end of the metal can body via a second seam, wherein food is located within a cavity defined by the metal can body and the can ends.

19. A metal, food can, can end comprising:

a center panel, wherein a center point of the can end is located within the center panel;

a bead panel having a top surface and a bottom surface located radially outside of the center panel, the bottom surface of the bead panel defining:

an inner downward bead and an outer downward bead located radially outside of the inner downward bead;

a counter-sink section located radially outside of the bead panel;

a wall extending upward from an outer edge of the counter-sink section;

a curled section extending radially outward from an upper edge of the wall; and a fixation point located radially inside of the outer downward bead configured to couple an opening mechanism to the can end, wherein the outer downward bead is a continuous bead that is concentric with the outer circumference of the can end, and further wherein the inner downward bead is a non-continuous bead having a first end and a second end, the first and second ends of the inner downward bead positioned on opposing lateral sides of the fixation point.

20. A metal, food can, can end comprising:

a center panel, wherein a center point of the can end is located within the center panel;

a bead panel having a top surface and a bottom surface located radially outside of the center panel, the bottom surface of the bead panel defining:

an inner downward bead and an outer downward bead located radially outside of the inner downward bead;

a counter-sink section located radially outside of the bead panel;

a wall extending upward from an outer edge of the counter-sink section; and a curled section extending radially outward from an upper edge of the wall;

wherein the inner downward bead is a non-continuous bead that is concentric with the outer downward bead for at least 180° and less than 360° around the can end.

* * * * *